US007634202B2

(12) United States Patent
Kitazawa et al.

(10) Patent No.: US 7,634,202 B2
(45) Date of Patent: Dec. 15, 2009

(54) IMAGE FORMING APPARATUS AND ABNORMALITY DETERMINATION METHOD FOR SUCH AN APPARATUS

(75) Inventors: Koji Kitazawa, Shiojiri (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 204 days.

(21) Appl. No.: 11/866,643

(22) Filed: Oct. 3, 2007

(65) Prior Publication Data

US 2008/0085131 A1 Apr. 10, 2008

(30) Foreign Application Priority Data

Oct. 6, 2006 (JP) ..... 2006-275636

(51) Int. Cl.
*G03G 15/02* (2006.01)

(52) U.S. Cl. ..... 399/9; 399/50; 399/89; 399/176

(58) Field of Classification Search ..... 399/9, 399/31, 50, 89, 168, 176, 174
See application file for complete search history.

(56) References Cited

U.S. PATENT DOCUMENTS 5,864,737 A * 1/1999 Obu et al. ..... 399/176
6,560,419 B2 * 5/2003 Sugiura ..... 399/50
2007/0147858 A1 * 6/2007 Inukai ..... 399/31

FOREIGN PATENT DOCUMENTS

JP 2004-085902 3/2004

* cited by examiner

*Primary Examiner*—David M Gray
*Assistant Examiner*—Gregory H Curran
(74) *Attorney, Agent, or Firm*—Hogan & Hartson LLP

(57) ABSTRACT

An image forming apparatus includes a plurality of image forming stations. In each image forming station an electrostatic latent image carrier and a charging member are arranged to face each other with a specified gap therebetween. A charging failure caused by an abnormal discharge in the gap is detected based on a current detection result by a current sensor, and an image forming station having an abnormality is reliably specified.

8 Claims, 12 Drawing Sheets

FIG. 4A: COLOR MODE
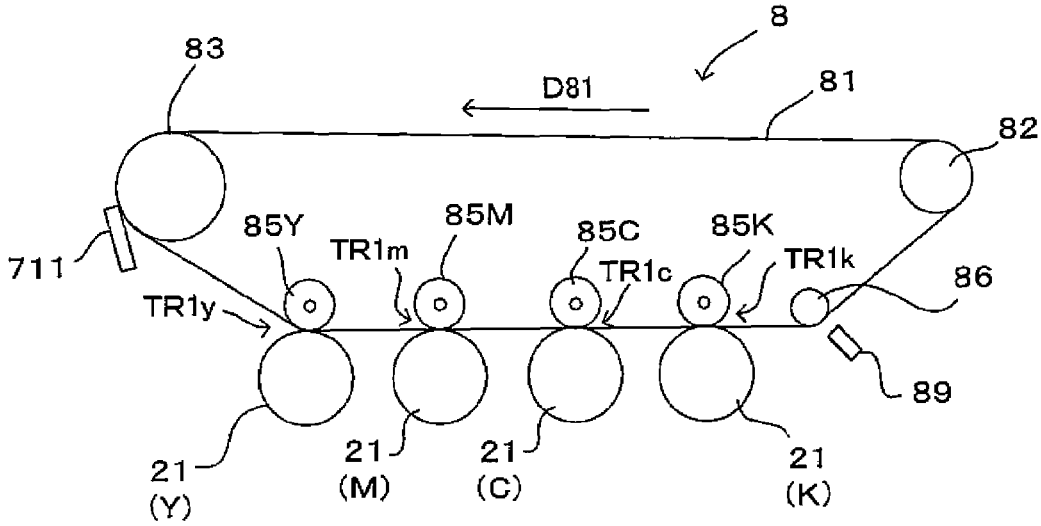
FIG. 4B: MONOCHROMATIC MODE
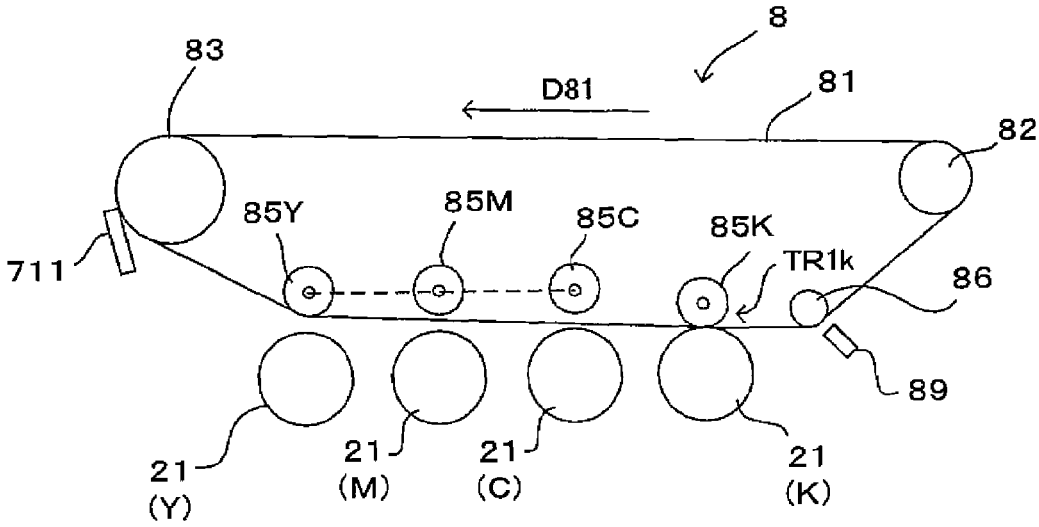

FIG. 8A: VOLTAGE WAVEFORM AT NODE N1
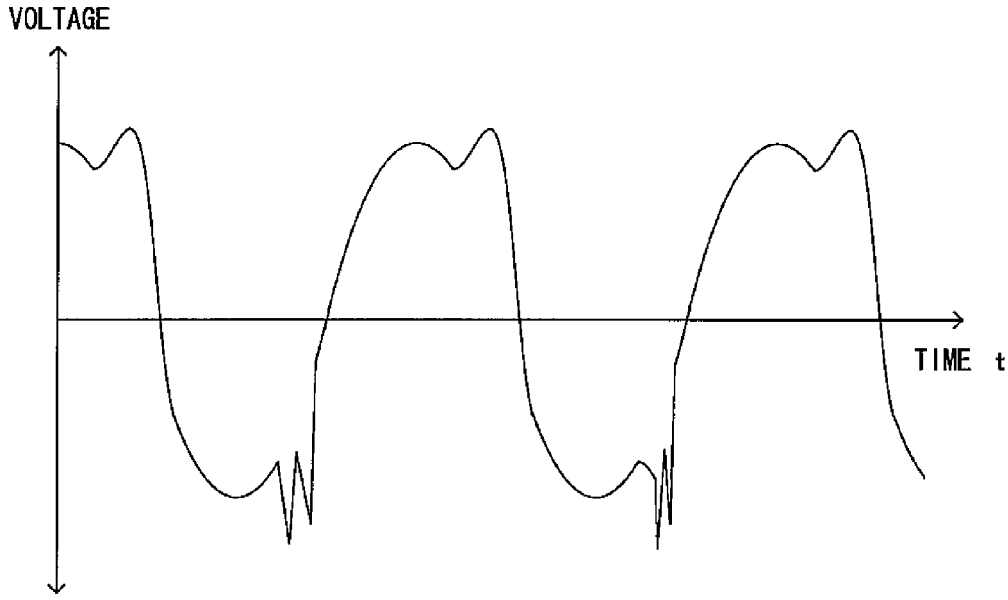
FIG. 8B: VOLTAGE WAVEFORM AT NODE N2
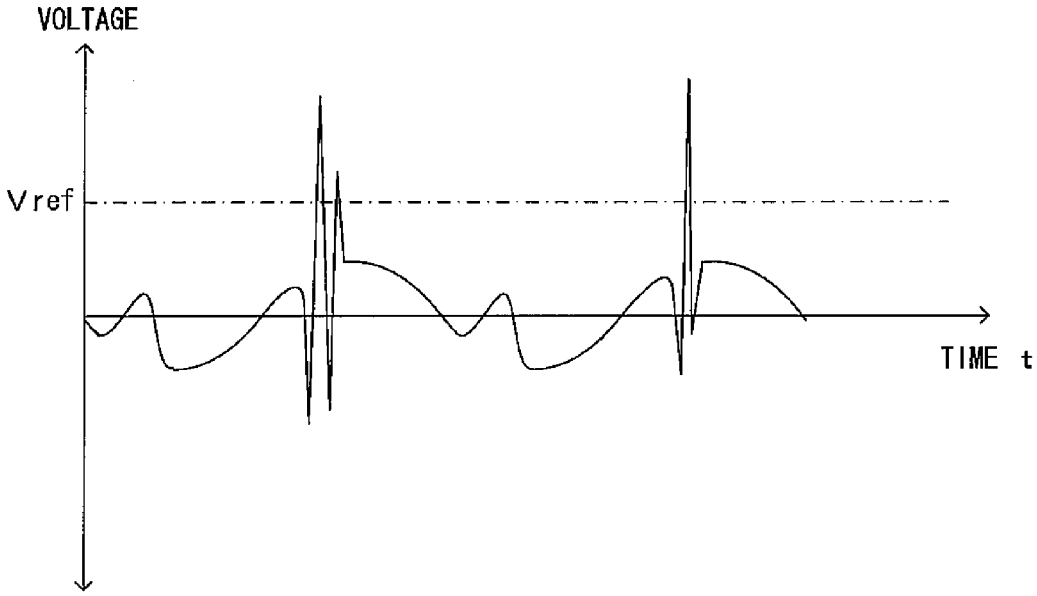

IMAGE FORMING APPARATUS AND ABNORMALITY DETERMINATION METHOD FOR SUCH AN APPARATUS

CROSS REFERENCE TO RELATED APPLICATION

The disclosure of Japanese Patent Application No. 2006-275636 filed Oct. 6, 2006 including specification, drawings and claims is incorporated herein by reference in its entirety.

BACKGROUND

1. Technical Field

The present invention relates to an image forming apparatus which charges an electrostatic latent image carrier by applying a charging bias having an alternating-current component to a charging member opposed to the electrostatic latent image carrier while defining a specified gap, and an abnormality determination method for such an image forming apparatus.

2. Related Art

For an image forming apparatus for forming an image by forming an electrostatic latent image on the outer surface of an electrostatic latent image carrier charged to a specified surface potential and developing the electrostatic latent image, technology for detecting a charging failure of the electrostatic latent image carrier has been proposed to prevent an image defect and the damage of the apparatus resulting from the charging failure of the electrostatic latent image carrier. For example, in an image forming apparatus disclosed in JP-A-2004-85902 (FIG. 5 for instance), a photosensitive member as the electrostatic latent image carrier is charged by applying an alternating-current bias to a charging roller held in contact with the outer surface of the photosensitive member and the presence or absence of a charging failure is determined by detecting the distortion of a charging current through the comparison of an average value and a peak value of the charging current flowing into the charging roller.

The above technology is applicable to apparatuses adopting a contact AC charging method, in which a charging member having an alternating-current bias applied thereto is held in contact with an electrostatic latent image carrier. As a different charging method, there is a non-contact AC charging method for applying an alternating-current bias to a charging member arranged at a specified gap from the electrostatic latent image carrier. However, not many proposals have been made for the technology for detecting a charging failure in the non-contact AC charging method. Particularly, as a problem peculiar to the non-contact AC charging method, abnormal discharge occurs in the gap between the electrostatic latent image carrier and the charging member and such abnormal discharge leads to a charging failure and the damage of the apparatus. However, the technology for detecting the charging failure resulting from such abnormal discharge has not been sufficiently studied thus far.

Further, in an image forming apparatus including a plurality of image forming stations, a bias power supply is shared by the plurality of image forming stations to reduce the number of parts and to downsize the apparatus. In such a case, it has been difficult to specify the image forming station having an abnormality even if an abnormal discharge should be detected based on the waveform of the current.

SUMMARY

An advantage of some aspects of the invention is to provide, in an image forming apparatus including a plurality of image forming stations in each of which an electrostatic latent image carrier and a charging member are arranged with a gap therebetween and in an abnormality determination method for such an image forming apparatus, a technology capable of precisely detecting a charging failure caused by an abnormal discharge in the gap and reliably specifying an image forming station having an abnormality.

According to a first aspect of the invention, there is provided an image forming apparatus, comprising: a plurality of image forming stations each including an electrostatic latent image carrier, a static eliminator that eliminates charges on the electrostatic latent image carrier, and a charging member that is arranged to face the electrostatic latent image carrier while defining a specified gap; a bias applicator that collectively applies charging bias voltages including alternating-current components to the charging members provided in collective bias image forming stations, the collective bias image forming stations being at least two of the plurality of image forming stations; a current sensor that collectively detects currents flowing in the charging members provided in the respective collective bias image forming stations; and a detector that detects an abnormal discharge in the gap between the electrostatic latent image carrier and the charging member based on a current detection result by the current sensor. And in the apparatus, the detector selects one of the collective bias image forming stations as a selected image forming station, and determines presence or absence of the abnormal discharge in the gap between the electrostatic latent image carrier and the charging member in the selected image forming station based on the current detection result by the current sensor when the bias applicator applies the charging bias voltages to the charging members in the respective collective bias image forming stations while causing the static eliminator provided in the selected image forming station to operate and causing the static eliminators provided in the collective bias image forming stations other than the selected image forming station to stop operating.

According to a second aspect of the present invention, there is provided an abnormality determination method for an image forming apparatus that comprises a plurality of image forming stations each including an electrostatic latent image carrier and a charging member arranged to face the electrostatic latent image carrier while defining a specified gap, comprising: collectively applying charging bias voltages including alternating-current components to the charging members provided in collective bias image forming stations, the collective bias image forming stations being at least two of the plurality of image forming stations; collectively detecting currents flowing in the charging members provided in the respective collective bias image forming stations in a condition that, after charged by the charging member, the charge on an outer surface of the electrostatic latent image carrier in a selected image forming station is eliminated, and that the charge on the outer surfaces of the electrostatic latent image carriers in the collective bias image forming stations other than the selected image forming station is not eliminated, one of the collective bias image forming stations being selected as the selected image forming station; and determining presence or absence of an abnormal discharge in the gap between the electrostatic latent image carrier and the charging member in the selected image forming station based on a current detection result.

In the invention constructed as above, the charging biases are collectively applied to a plurality of image forming stations and the currents flowing in the charging members are collectively detected. Thus, the number of parts can be reduced and the apparatus can be downsized. However, in the construction for collectively performing both the application of the biases and the detection of the currents, even if an abnormal current resulting from an abnormal discharge is detected, it is difficult to specify in which image forming station the abnormal discharge is occurring.

According to the knowledge of the inventors of the present application, the abnormal discharge in the gap between the electrostatic latent image carrier and the charging member occurs due to a large potential difference between the electrostatic latent image carrier in a charge-eliminated state and the charging member having a high-voltage charging bias applied thereto. On the other hand, unless the charge on the electrostatic latent image carrier is eliminated, a potential difference between the charging member and the electrostatic latent image carrier is small and no discharge occurs since the surface potential approximate to the potential immediately after the charging is kept.

Accordingly, in the invention, one of the electrostatic latent image carrier is charge-eliminated and the other electrostatic latent image carriers are not charge-eliminated, whereby only one selected image forming station out of the image forming stations having the charging biases collectively applied thereto satisfies a discharge occurrence condition. Thus, by detecting whether or not the abnormal discharge occurs in this state, the presence or absence of the abnormal discharge can be individually determined only for this image forming station independently of the other image forming stations. Further, by making such determination for each of the image forming stations, the image forming station having the abnormality can be reliably specified.

Particularly, the image forming station in which the abnormal discharge is occurring in the gap can be reliably specified out of the collective bias image forming stations by selecting the collective bias image forming stations one by one in sequence as the selected image forming station.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 4A and 4B are diagrams showing the primary transfer positions.

FIGS. 8A and 8B are graphs showing voltage waveforms at the respective parts of the abnormal current sensor.

DESCRIPTION OF EXEMPLARY EMBODIMENTS

Figure 1:
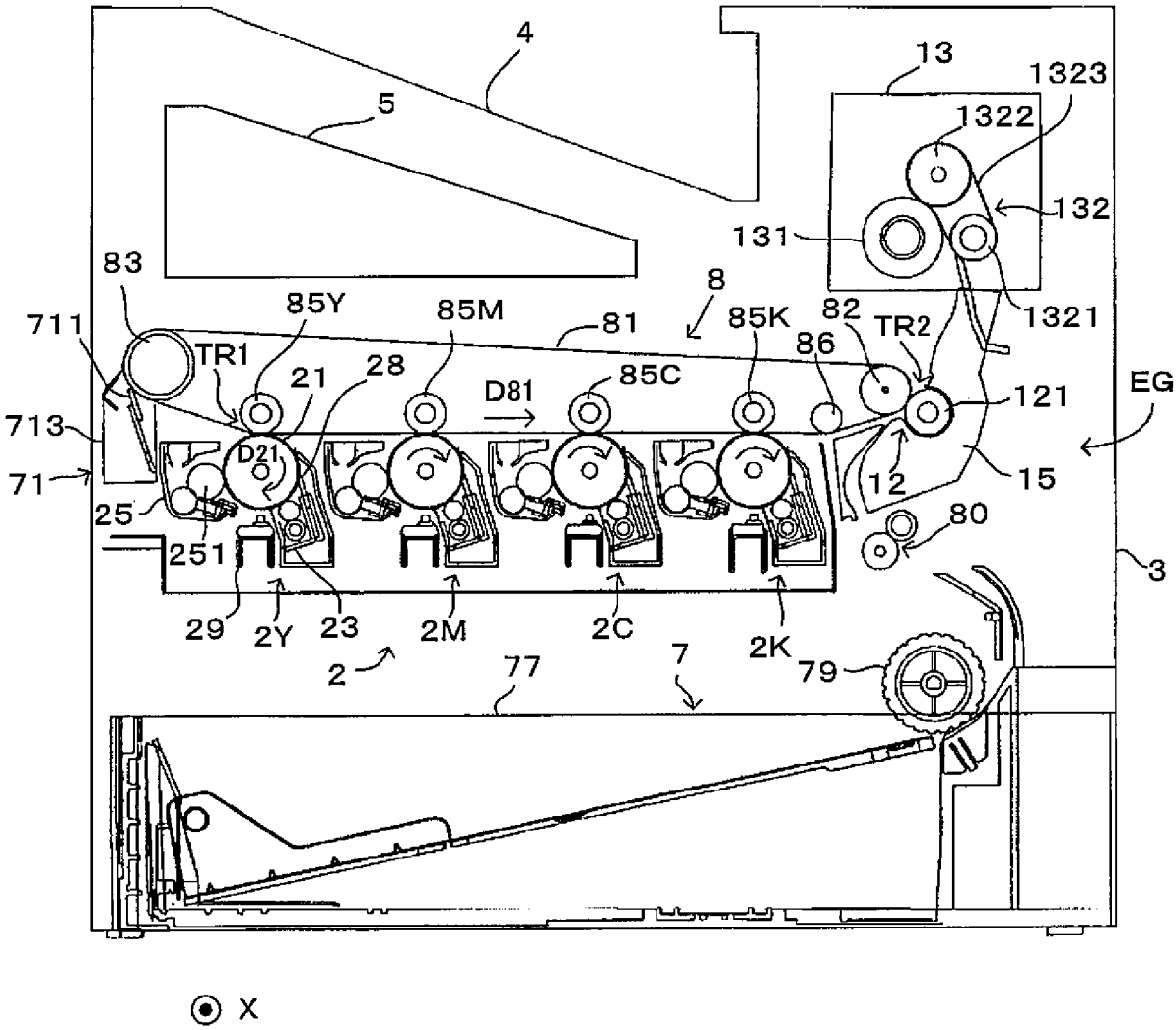
FIG. 1 is a diagram showing an embodiment of an image forming apparatus according to the invention.
Figure 2:
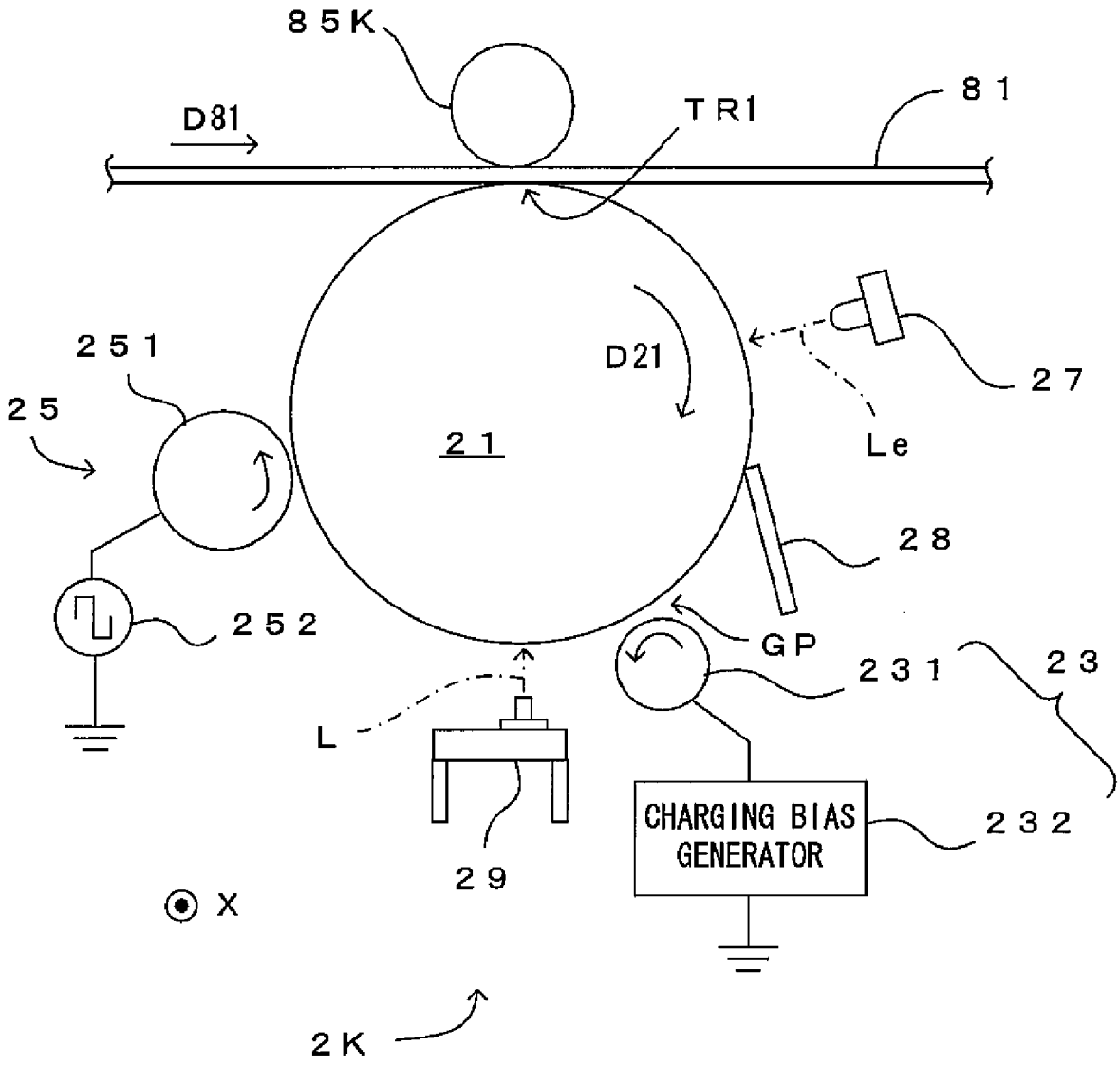
FIG. 2 is a diagram showing the construction of a main part of an image forming station in the image forming apparatus of FIG. 1.

FIG. 1 is a diagram showing an embodiment of an image forming apparatus according to the invention, and FIG. 2 is a diagram showing a construction of a main part of an image forming station in the image forming apparatus of FIG. 1. This apparatus is an image forming apparatus capable of selectively executing a color mode for forming a color image by superimposing four colors of toners of yellow (Y), magenta (M), cyan (C) and black (K) and a monochromatic mode for forming a monochromatic image using only the toner of black (K). In this image forming apparatus, when an image forming command is given from an external apparatus such as a host computer to a main controller including a CPU, a memory and the like, the main controller feeds a control signal to an engine controller, which controls the respective parts of the apparatus such as an engine unit EG in accordance with the control signal to perform a specified image forming operation, thereby forming an image corresponding to the image forming command to a sheet as a recording material such as a copy paper, a transfer paper, a sheet or a transparent sheet for OHP.

An electrical component box 5 having a power supply circuit board, a controller board and the like built therein is disposed in a housing main body 3 of the image forming apparatus according to this embodiment. An image forming unit 2, a transfer belt unit 8 and a sheet feeding unit 7 are also arranged in the housing main body 3. Further, a secondary transfer unit 12, a fixing unit 13 and a sheet guiding member 15 are arranged in the inner right side of the housing main body 3 in FIG. 1. It should be noted that the sheet feeding unit 7 is detachably mountable into the housing main body 3. Each of the sheet feeding unit 7 and the transfer belt unit 8 can be detached for repair or exchange.

The image forming unit 2 includes four image forming stations 2Y (for yellow), 2M (for magenta), 2C (for cyan) and 2K (for black). In FIG. 1, since the respective image forming stations of the image forming unit 2 are identically constructed, the construction of only one of the image forming stations is identified by reference numerals to simplify the graphical representation and those of the other image forming stations are not identified by reference numerals.

Each of the image forming stations 2Y, 2M, 2C and 2K includes a drum-shaped photosensitive member 21, on the outer surface of which a toner image of a corresponding color is to be formed. Each photosensitive member 21 is connected to a special driving motor (not shown) to be drivingly rotated at a specified speed in a direction of an arrow D21 in FIG. 1. Further, a charger 23, a line head 29, a developer 25, a static eliminating light source 27 and a photosensitive member cleaner 28 are arranged around the photosensitive member 21 in a rotating direction of the photosensitive member 21. A charging operation, a latent image forming operation and a toner developing operation are performed by these functional sections. At the time of executing the color mode, a color image is formed by superimposing toner images formed by all the image forming stations 2Y, 2M, 2C and 2K on a transfer belt 81 provided in the transfer belt unit 8. Further, at the time of executing the monochromatic mode, only the image forming station 2K is operated to form a black monochromatic image.

Figure 3:
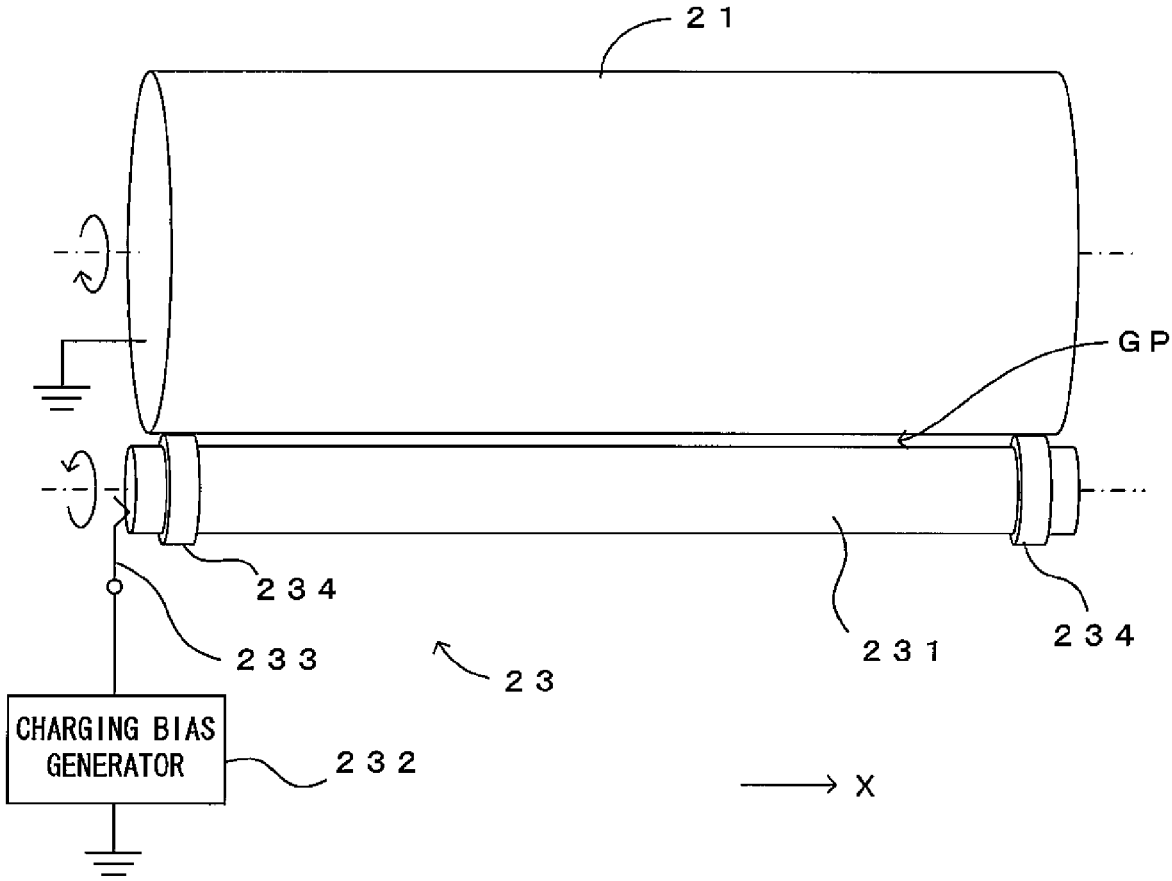
FIG. 3 is a diagram showing the construction of the charger.

FIG. 3 is a diagram showing the construction of the charger. The charger 23 includes a charging roller 231 having the outer surface thereof made of a metal material such as iron, aluminum or stainless steel. Rollers 234 made of an insulating material are mounted at the opposite ends of this charging roller 231, and a specific gap GP is defined between the charging roller 231 and the outer surface of the photosensitive member 21 by the contact of the rollers 234 with the outer surface of the photosensitive member 21. One end of a sliding terminal 233 made of an elastic and electrically conductive plate material such as stainless steel or phosphor bronze is slidably connected with an end face of the charging roller 231, and the other end thereof is connected with a charging bias generator 232, whereby an alternating-current charging bias voltage from the charging bias generator 232 is applied to the charging roller 231 via the sliding terminal 233. Thus, the outer surface of the photosensitive member 21 can be charged to a specified surface potential. In the following description, one alphabet corresponding to the toner color is affixed to the end of the reference numeral 231 when it is particularly necessary to distinguish the charging rollers of the respective image forming stations. For example, the charging roller provided in the black image forming station 2K is identified by the reference numeral 231K.

Referring back to FIG. 1, the construction of the apparatus is further described. The line head 29 includes a plurality of light emitting elements arrayed in the axial direction of the photosensitive member 21 (direction X normal to the plane of FIG. 1), and is arranged to face the photosensitive member 21. Light beams L are emitted from these light emitting elements toward the outer surface of the photosensitive member 21 charged by the charger 23 to form an electrostatic latent image on this outer surface.

The developer 25 includes a developing roller 251 carrying toner on the outer surface thereof. By a development bias applied from a development bias generator (not shown) electrically connected with the developing roller 251 to the developing roller 251, the charged toner moves from the developing roller 251 to the photosensitive member 21 at a developing position where the developing roller 251 and the photosensitive member 21 are in contact, whereby the electrostatic latent image formed on the outer surface of the photosensitive member 21 is developed.

The toner images developed at the developing positions are primarily transferred to the transfer belt 81 at primary transfer positions TR1 where the transfer belt 81 to be described in detail later and the respective photosensitive members 21 are in contact after being conveyed in rotating directions D21 of the photosensitive members 21.

Further, the static eliminating light source 27 faced toward the photosensitive member 21 and the photosensitive member cleaner 28 held in contact with the outer surface of the photosensitive member 21 are arranged in this order at a side downstream of the primary transfer position TR1 and upstream of the charger 23 in the rotating direction D21 of each photosensitive member 21. The static eliminating light source 27 resets the surface potential of the photosensitive member 21 by irradiating a static eliminating light beam Le to the outer surface of the photosensitive member 21 after the primary transfer, and the photosensitive member cleaner 28 is held in contact with the outer surface of the photosensitive member to remove the toner remaining on the outer surface of the photosensitive member 21 after the primary transfer for cleaning. The outer surface of the photosensitive member 21 having the charge eliminated and toner removed is conveyed again to the position to face the charging roller 231 and charged by the charger 23 for the formation of an electrostatic latent image.

The transfer belt unit 8 includes a drive roller 82, a driven roller (blade facing roller) 83 disposed at the left of the drive roller 82 in FIG. 1, and the transfer belt 81 mounted on these rollers and driven to turn in a direction (conveying direction) of an arrow D81 of FIG. 1 by the drive roller 82. The transfer belt unit 8 also includes four primary transfer rollers 85Y, 85M, 85C and 85K arranged at the inner side of the transfer belt 81 to face the respective photosensitive members 21 of the respective image forming stations 2Y, 2M, 2C and 2K in a one-to-one correspondence when cartridges are mounted. These primary transfer rollers are respectively electrically connected to a primary transfer bias generator (not shown).

FIGS. 4A and 4B are diagrams showing the primary transfer positions. At the time of executing the color mode, all the primary transfer rollers 85Y, 85M, 85C and 85K are positioned toward the image forming stations 2Y, 2M, 2C and 2K as shown in FIG. 4A, thereby pressing the transfer belt 81 into contact with the photosensitive members 21 of the image forming stations 2Y, 2M, 2C and 2K to define the primary transfer positions TR1*y*, TR1*m*, TR1*c* and TR1*k* between the respective photosensitive members 21 and the transfer belt 81. By applying primary transfer biases from the primary transfer bias generator to the primary transfer roller 85Y and the like at suitable timings, the toner images formed on the outer surfaces of the respective photosensitive members 21 are transferred to the outer surface of the transfer belt 81 at the corresponding primary transfer positions. In other words, the monochromatic toner images of the respective colors are superimposed one above another on the transfer belt 81 to form a color image in the color mode.

On the other hand, at the time of executing the monochromatic mode, out of the four primary transfer rollers, the primary transfer rollers 85Y, 85M and 85C are separated from the facing image forming stations 2Y, 2M and 2C and only the primary transfer roller 85K corresponding to the black color is held in contact with the image forming station 2K as shown in FIG. 4B, whereby only the image forming station 2K for monochromatic printing is held in contact with the transfer belt 81. As a result, the primary transfer position TR1*k* is defined only between the primary transfer roller 85K and the image forming station 2K. By applying a primary transfer bias from the primary transfer bias generator to the primary transfer roller 85K at a suitable timing, the black toner image formed on the outer surface of the photosensitive member 21 provided in the image forming station 2K is transferred to the outer surface of the transfer belt 81 at the primary transfer position TR1*k* to form a monochromatic image.

The transfer belt unit 8 further includes a downstream guide roller 86 disposed at downstream of the primary transfer roller 85K for black and upstream of the drive roller 82. This downstream guide roller 86 is arranged in contact with the transfer belt 81 on a tangent line common to the primary transfer roller 85K and the photosensitive member 21(K) for black at the primary transfer position TR1 defined by the contact of the primary transfer roller 85K and the photosensitive member 21 of the image forming station 2K.

A patch sensor 89 is disposed at a position facing the outer surface of the transfer belt 81 mounted on the downstream guide roller 86. The patch sensor 89 is, for example, a reflection-type photosensor, and detects the position and density of a patch image formed on the transfer belt 81 if necessary by optically detecting a change in the reflectivity of the outer surface of the transfer belt 81.

The sheet feeding unit 7 includes a sheet feeder comprised of a sheet cassette 77 capable of accommodating a stack of sheets and a pickup roller 79 for dispensing the sheets one by one from the sheet cassette 77. The sheet dispensed from the sheet feeder by the pickup roller 79 is fed along the sheet guiding member 15 to a secondary transfer position TR2 where the drive roller 82 and a secondary transfer roller 121 are in contact after a sheet feeding timing thereof is adjusted by a pair of registration rollers 80.

The secondary transfer roller 121 is movably structured to abut on and move away from the transfer belt 81, and is driven to abut on and move away from the transfer belt 81 by a secondary transfer roller driving mechanism (not shown). The fixing unit 13 includes a rotatable heating roller 131 having a heating element such as a halogen heater built therein, and a pressing device 132 for pressing and biasing the heating roller 131. The sheet having an image secondarily transferred to the outer surface thereof is guided to a nip portion defined between the heating roller 131 and a pressure belt 1323 of the pressing device 132 by the sheet guiding member 15, and the image is thermally fixed at a specified temperature at the nip portion. The pressing device 132 is comprised of two rollers 1321 and 1322 and the pressure belt 1323 mounted on these rollers. By pressing a part of the outer surface of the pressure belt stretched between the two rollers 1321 and 1322 against the outer circumferential surface of the heating roller 131, the nip portion defined between the heating roller 131 and the pressure belt 1323 is formed to be wide. The sheet subjected to a fixing process in this way is conveyed to a discharge tray 4 provided on the top surface of the housing main body 3.

The aforementioned drive roller 82 functions to drivingly turn the transfer belt 81 in the direction of the arrow D81 in FIG. 1 and also functions as a backup roller for the secondary transfer roller 121. A rubber layer having a thickness of about 3 mm and a volume resistivity of 1000 kΩ·cm or below is formed on the outer circumferential surface of the drive roller 82, and serves as an electrical conduction path of a secondary transfer bias supplied from an unillustrated secondary transfer bias generator via the secondary transfer roller 121 by being grounded via a metallic shaft. By providing the highly frictional and impact absorbing rubber layer on the drive roller 82 in this way, image deterioration resulting from the transmission of an impact to the transfer belt 81 given upon the arrival of the sheet to the secondary transfer position TR2 can be prevented.

Further, a cleaning device 71 is arranged to face the blade facing roller 83 in this apparatus. The cleaning device 71 includes a cleaner blade 711 and a waste toner box 713. The cleaner blade 711 has the tip thereof held in contact with the blade facing roller 83 via the transfer belt 81, whereby foreign matters such as toner residual on the transfer belt 81 after the secondary transfer and paper powder can be removed. The foreign matters removed in this manner are collected into the waste toner box 713. The cleaner blade 711 and the waste toner box 713 are constructed to be integral to the blade facing roller 83.

In this embodiment, the photosensitive member 21, the charging roller 231, the developer 25, the static eliminating light source 27 and the photosensitive member cleaner 28 of each of the image forming stations 2Y, 2M, 2C and 2K are integrally unitized into a cartridge. These cartridges are detachably mountable into an apparatus main body. Each cartridge includes a nonvolatile memory for storing information on this cartridge. The usage histories and the lives of articles of consumption of the respective cartridges are administered based on these pieces of information.

Figure 5:
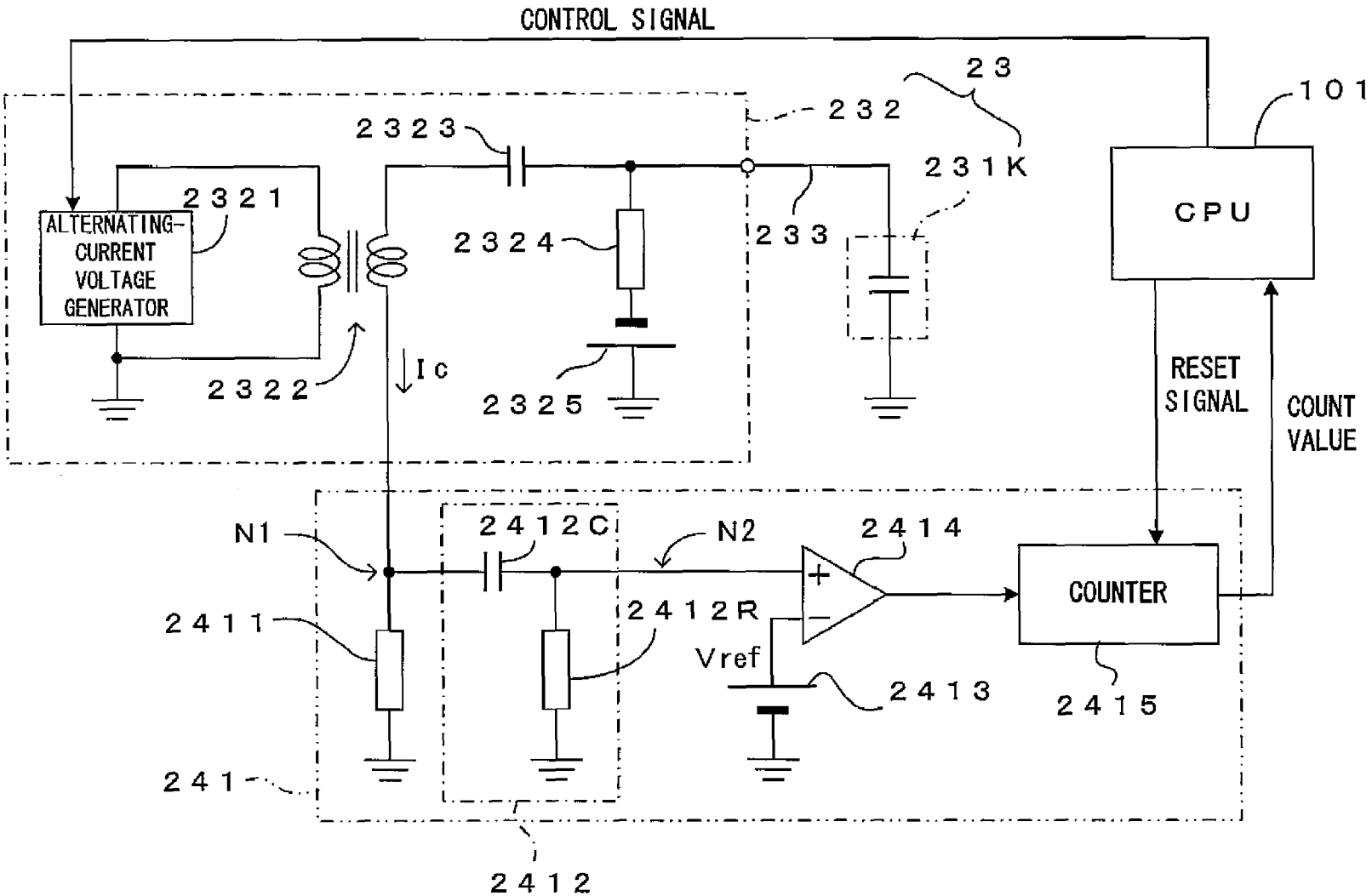
FIG. 5 is a diagram showing the electrical construction of the charger of the black image forming station.

FIG. 5 is a diagram showing the electrical construction of the charger of the black image forming station. As described above, the charger 23 includes the charging roller and the charging bias generator. The charging roller 231K can be equivalently expressed as a capacitor formed between the charging roller 231K and the photosensitive member 21 disposed at the gap from the charging roller 231K and having the core thereof grounded. The charging bias generator 232 includes an alternating-current voltage generator 2321 controlled by a CPU 101 for controlling the overall operation of the apparatus. The alternating-current voltage generator 2321 generates an alternating-current voltage having specified frequency and amplitude in accordance with a control signal from the CPU 101. Although a sinusoidal alternating-current voltage is generated in this embodiment, an alternating-current voltage having a rectangular or triangular waveform may be generated.

The alternating-current voltage generated by the alternating-current voltage generator 2321 is boosted by a transformer 2322, and the boosted alternating-current voltage is applied to the charging roller 231K via a capacitor 2323 for cutting off a direct current. A direct-current voltage from a direct-current power supply 2325 is also applied to the charging roller 231K via a resistor 2324, and a charging bias voltage obtained by applying the sinusoidal alternating-current voltage to the direct-current voltage is applied to the charging roller 231K as a whole. The direct-current voltage applied to the charging roller 231K is, for example, a negative voltage of about (−600) V and determines the charged potential of the photosensitive member 21. On the other hand, the alternating-current voltage applied to the charging roller 231K is, for example, a sinusoidal alternating-current voltage having an inter-peak voltage of about 1500 V and a frequency of about 1 to 2 KHz, and promotes movements of electric charges to the photosensitive member 21 to efficiently charge the photosensitive member 21 by causing a discharge in the gap GP between the charging roller 231K and the photosensitive member 21 although it has no direct relationship with the charged potential of the photosensitive member 21.

A charging current Ic flowing into the charging roller 231K via the transformer 2322 is inputted to an abnormal current sensor 241. The construction and operation of the abnormal current sensor 241 is described in detail later. Prior to this, the knowledge on a relationship between the charging bias voltage and the charging current the inventors of the present application obtained through an experiment is described.

Figure 6:
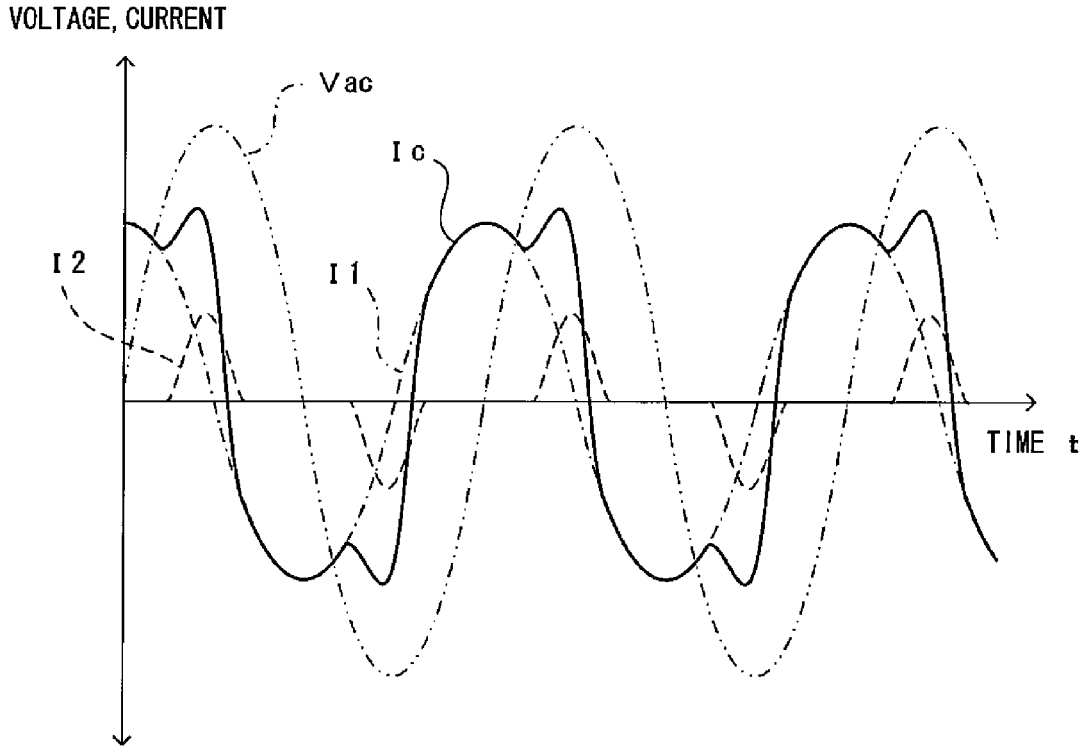
FIG. 6 is a graph showing the relationship between the charging bias voltage and the charging current.

FIG. 6 is a graph showing the relationship between the charging bias voltage and the charging current. When the charging bias voltage in which the direct-current voltage and the alternating-current voltage are superimposed is applied to the charging roller 231K, the charging current Ic flowing into the charging roller 231K includes a current component I1 whose phase is advanced by 90 degrees relative to an alternating-current component Vac of the charging bias and a current component I2 that flows only for a short period of time at a timing corresponding to the peak of the alternating-current voltage Vac of the charging bias. Out of these, the current component I1 is a current for charging and discharging an electrostatic capacity formed by the charging roller 231K and the photosensitive member 21.

The current component I2 is a current resulting from a discharge occurring in the gap GP between the charging roller 231K and the photosensitive member 21. In order to uniformly charge the outer surface of the photosensitive member 21, it is desirable that the discharge uniformly occurs in the entire gap GP in the axial direction (direction X shown in FIG. 3) of the charging roller 231K. When the charging operation for the photosensitive member 21 is normally performed in this way, the current component I2 resulting from the discharge has a relatively broad waveform. Accordingly, the waveform of the charging current Ic obtained by combining these current components is as shown in FIG. 6. Specifically, in an image forming apparatus of the so-called noncontact AC charging type in which an alternating-current charging bias is applied while a charging member and a photosensitive member are held separated from each other as in this embodiment, the waveform of the charging current Ic is originally distorted and the abnormality detection method disclosed in JP-A-2004-85902 focusing merely on the peak value and the average value of the current cannot be applied.

Figure 7:
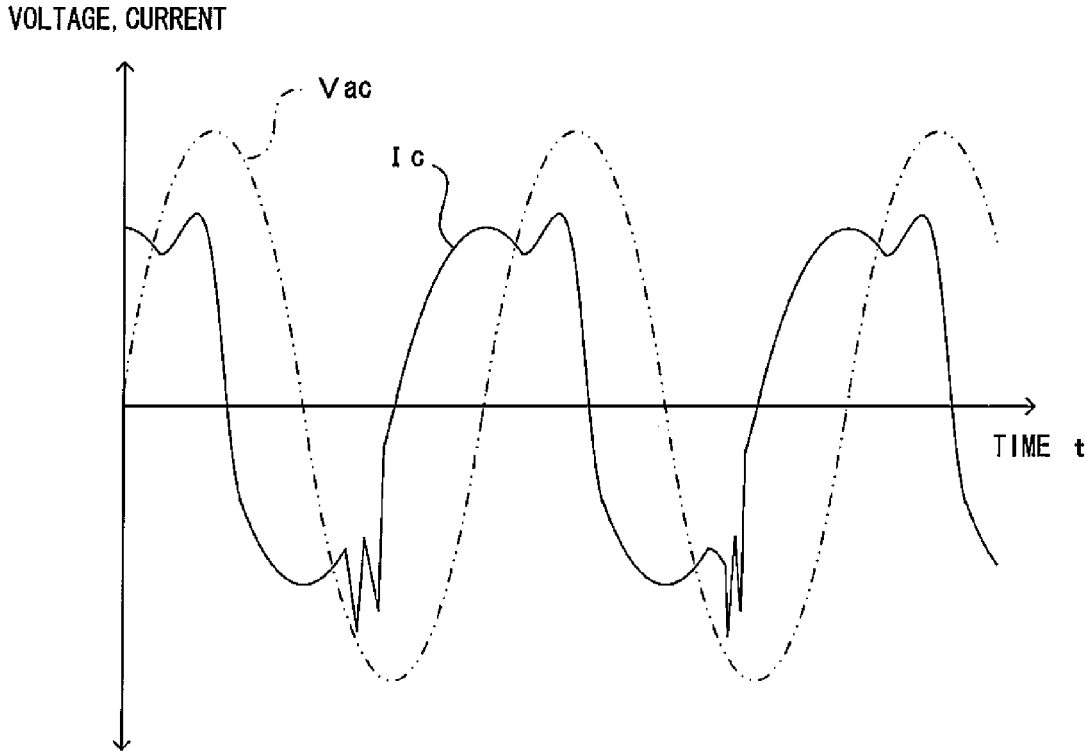
FIG. 7 is a graph showing a charging current waveform at the time of an abnormal discharge.

FIG. 7 is a graph showing a charging current waveform at the time of an abnormal discharge. There are cases where the gap GP varies due to the unevenness of the outer surface of the charging roller 231K left after the working process, the adherence of extraneous matters such as toner and paper powder to the outer surface of the charging roller 231K or the photosensitive member 21, and the adherence of extraneous matters to the outer surfaces of the rollers 234. Upon such a variation of the gap, the discharge in the gap becomes nonuniform or localized, and a large current flows into the charging roller 231 during a very short period of time. As a result, the waveform of the charging current Ic comes to include components in the form of sharp pulses. Such pulses are mainly generated near the peaks of the alternating-current component Vac of the charging bias at one side where a potential difference between the outer surface of the photosensitive member 21 having the charge eliminated and the charging roller 231K having the charging bias applied thereto are largest as shown in FIG. 7. In other words, a charging failure resulting from an abnormal discharge can be detected by extracting and detecting only these pulse components.

For example, an occurrence of the abnormal discharge in the gap can be judged when the number of pulses detected by a current sensor within a specified detection period exceeds a specified threshold value. According to the experiment by the inventors of the present application, the discharge repeatedly occurs at a relatively high probability when abnormal discharge occurring conditions are satisfied. Thus, an occurrence of the abnormal discharge can be detected with high accuracy by assuming that the abnormal discharge has occurred when the number of the detected pulses exceeds a certain threshold value.

Based on the above knowledge, the abnormal current sensor 241 shown in FIG. 5 is devised to accurately detect a charging failure resulting from the abnormal discharge. Specifically, this abnormal current sensor 241 includes a resistor 2411 as an IV converter for converting the charging current Ic into a voltage, a high-pass filter 2412 constructed by a differentiating circuit comprised of a capacitor 2412C and a resistor 2412R, a comparator 2414 for comparing a filter output with a reference level Vref outputted from a voltage reference 2413, and a counter 2415 for counting the number of pulses outputted from the comparator 2414.

The high-pass filter 2412 is provided to cut off direct-current components and to extract the pulse components from the charging current waveform. The charging current Ic in a normal case mainly includes a fundamental wave having the same frequency as the alternating-current component Vac of the charging bias and relatively low-order harmonic components of the fundamental wave as shown in FIG. 6. Accordingly, the high-pass filter 2412 is required to pass even higher frequency components while attenuating these frequency components. The cutoff frequency of the high-pass filter 2412 is preferably set at least higher than the frequency of the alternating-current component Vac of the charging bias, and more preferably set to about several times as high as the frequency of the alternating-current component Vac.

FIGS. 8A and 8B are graphs showing voltage waveforms at the respective parts of the abnormal current sensor. When the voltage waveform at a node N1 which is an input side of the high-pass filter 2412 has the waveform shown in FIG. 8A, the one at a node N2 which is an output side of the high-pass filter 2412 comes to be accentuated with sudden changes as shown in FIG. 8B. In the comparator 2414 to which an output signal of the high-pass filter 2412 is inputted, the level of the received signal is compared with the predetermined reference level Vref and outputs a high level signal when the input signal level exceeds the reference level Vref.

The counter 2415 is, for example, a counter including a D flip-flop, and a count value thereof is incremented by one when the output signal of the comparator 2414 changes from low level to high level. The count value by the counter 2415 is inputted to the CPU 101, whereas a reset signal for resetting the count value is outputted from the CPU 101 to the counter 2415 when needed. The CPU 101 judges the presence or absence of an occurrence of the charging failure of the photosensitive member 21 as described below based on the count value of the counter 2415.

Figure 9:
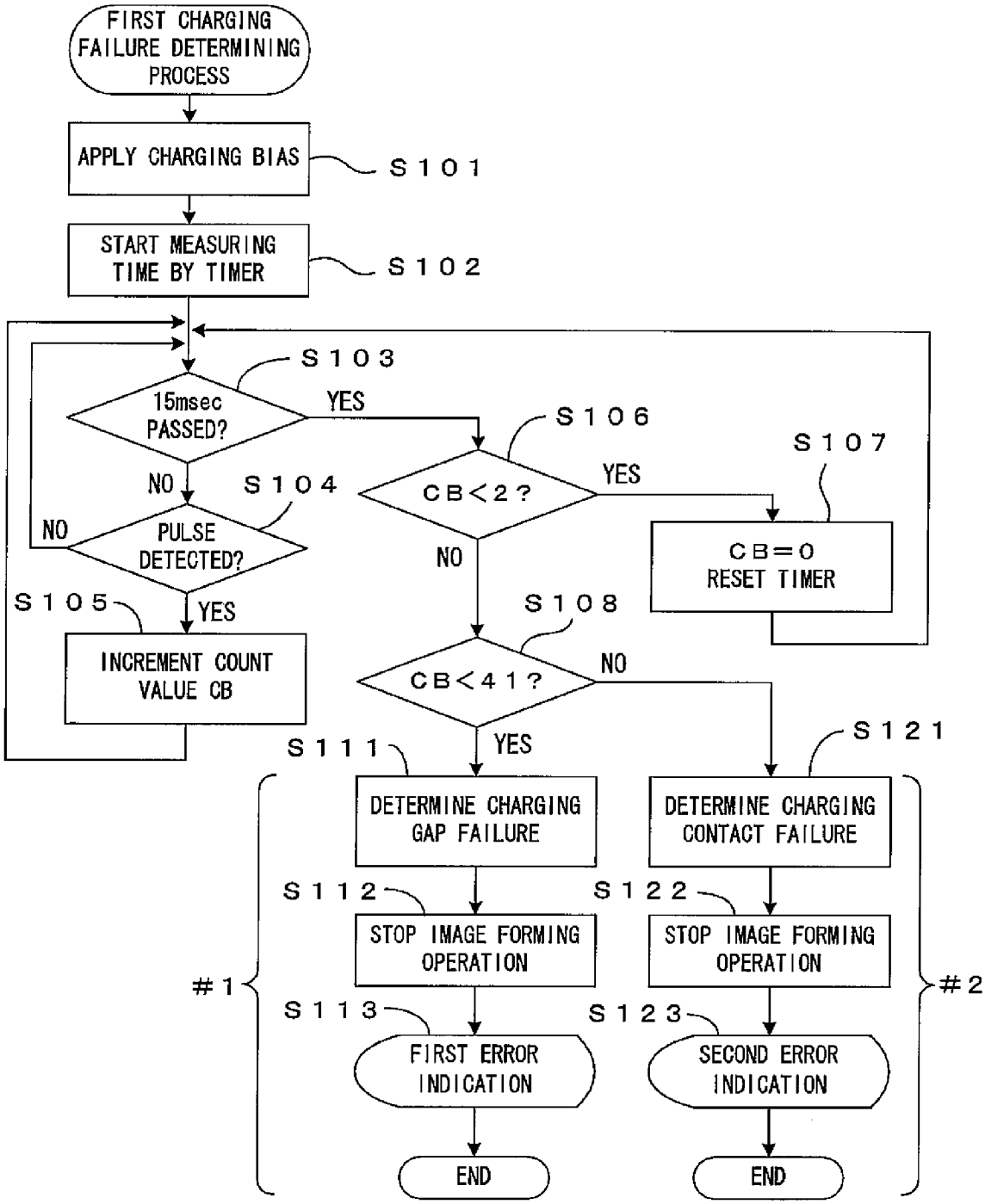
FIG. 9 is a flow chart showing a first charging failure determining process.

FIG. 9 is a flow chart showing a first charging failure determining process. This process is for detecting the charging failure in the black image forming station 2K, and a method for detecting charging failures in the other image forming stations is described later. This first charging failure determining process is carried out as the image forming operation is performed. When the application of the charging bias voltage to the charging roller 231K is started in the image forming operation (Step S101), the CPU 101 starts measuring time by an unillustrated internal timer (Step S102).

Then, until the measured time by the timer reaches 15 msec (Step S103), it is judged whether or not the signal outputted from the comparator 2414 contains any pulse exceeding the reference level Vref (Step S104). Every time the pulse is detected, the count value CB by the counter 2415 is incremented by one (Step S105). It should be noted that the increment of the count value is actually automatically executed on the hardware of the counter 2415.

Upon the lapse of 15 msec after the start of the time measurement, the count value CB of the counter 2415 during this period is compared with a constant 2 (Step S106). According to the experiment by the inventors of the present application, once such an abnormal discharge as to cause an image defect and the damage of the apparatus occurs, an abnormal discharge similarly occurs in many of several cycles of subsequent charging bias voltage changes in most cases, and resulting pulses can be observed in the current waveform. Accordingly, if the number of pulses detected during a certain detection period is below 2, an occurrence of no such abnormal discharge as to leading to an image defect and the damage of the apparatus may be judged. Thus, the reset signal is outputted to the counter 2415 to reset the count value CB, and the internal timer is reset (Step S107), and the process from Step S103 on is repeated.

The length of the detection period may be determined as follows. As described above, a pulse substantially synchronized with the alternating-current component of the charging bias voltage appears when such an abnormal discharge as to lead to the image defect and the damage of the apparatus occurs. Accordingly, in order to reliably detect this pulse, the length of the detection period is preferably set longer than at least the cycle of the alternating-current component of the charging bias voltage. On the other hand, if the detection period is too long, it takes a long time until the detection of the abnormal discharge upon an occurrence of the abnormal discharge. As a result, it takes time to curb the abnormal discharge, thereby damaging the image and the apparatus. Therefore, the length of the detection period is suitably set equivalent to several to several tens cycles of the alternating-current component of the charging bias voltage. In this embodiment, since the alternating-current frequency of the charging bias is set at 1.3 kHz and the detection period is set to be twenty cycles of the bias, the length of the detection period is about 15 msec.

Further, the reference level Vref can be suitably determined in accordance with the material of the charging roller 231K and the magnitude of the bias voltage. Although the charging roller in this embodiment is a metallic roller, a rubber roller made of a resin material such as urethane rubber or silicon rubber, in which electrically conductive fine powder is dispersed, may be used. The reference level Vref needs to be changed according to the property of this rubber roller.

A certain charging failure is thought to have occurred when the count value CB is two or larger, that is, two or more pulses were detected within the detection period at Step S106. Next, it is attempted to specify the cause of pulse generation as follows.

According to the knowledge of the inventors of the present application, main causes why such a pulse waveform appears in the charging current include nonuniform discharge in the aforementioned gap and a contact failure between the charging roller 231K and the sliding terminal 233. Such a contact failure occurs because foreign matters such as grease, toner and paper powder are jammed between the charging roller 231K and the sliding terminal 233 to make the electrical connection unstable. Pulses resulting from the nonuniform discharge in the gap are generated substantially in synchronization with changes of the alternating-current component of the charging bias as described above, whereas pulses resulting from the contact failure substantially randomly appear and the generation frequency thereof is much higher. Therefore, the cause of pulse generation can be estimated from the generation frequency of the pulse.

In this embodiment, considering that the changes of the charging bias voltage within 15 msec as the detection period are 20 cycles, two pulses per cycle, that is, a total of forty pulses are judged to result from the gap variation. The pulses exceeding this level are judged to result from the contact failure.

Specifically, the count value CB of the counter 2415 during the detection period is judged (Step S108), and when the count value is 40 or below, it is determined that the pulses are resulted from an abnormal discharge caused by the variation of the gap GP (Step S111). Then, an error process #1 corresponding to the charging failure caused by the variation of the gap GP is performed. Here, the image forming operation is stopped to prevent the image defect resulting from the charging failure or the damage of the apparatus by the abnormal discharge (Step S112), and the application of the charging bias to the charging roller 231 is immediately stopped. Further, a specified first error indication is displayed to notify abnormality to a user (Step S113). The error indication in this case indicates an occurrence of the charging failure resulting from the gap variation in the black image forming station 2K.

On the other hand, when the count value CB exceeds 40, it is determined that pulses are generated by the contact failure between the charging roller 231K and the sliding terminal 233 (Step S121), and an error process #2 corresponding to the charging failure caused by the contact failure is performed. In this case, there is little likelihood of damaging the apparatus due to the abnormal discharge, but the image defect caused by the charging failure can occur. Hence, the image forming operation is stopped just the same (Step S122). Then, a second error indication is displayed which indicates that the charging error resulting from the contact failure has occurred in the black image forming station 2K (Step S123).

Next, a method for detecting the charging failure in the image forming stations 2Y, 2M and 2C other than the black one is described. As described above, in the image forming apparatus of this embodiment, the color mode for forming a color image by operating the image forming stations of all four colors and the monochromatic mode for forming a monochromatic image by operating only the black image forming station 2K can be selectively executed. Accordingly, the black image forming station needs to be singly operated separately from the other image forming stations, but the image forming stations 2Y, 2M and 2C of the other three colors need not be singly operated. Thus, in this embodiment, some of the functions of the charging bias generator are shared among these image forming stations, thereby reducing the number of parts and downsizing the apparatus. Further, by independently providing the charging bias generator for the black image forming station 2K, the application of unnecessary biases in the monochromatic mode to the charging rollers 231 of the image forming stations other than the black one is prevented to extend the lives of these image forming stations.

Figure 10:
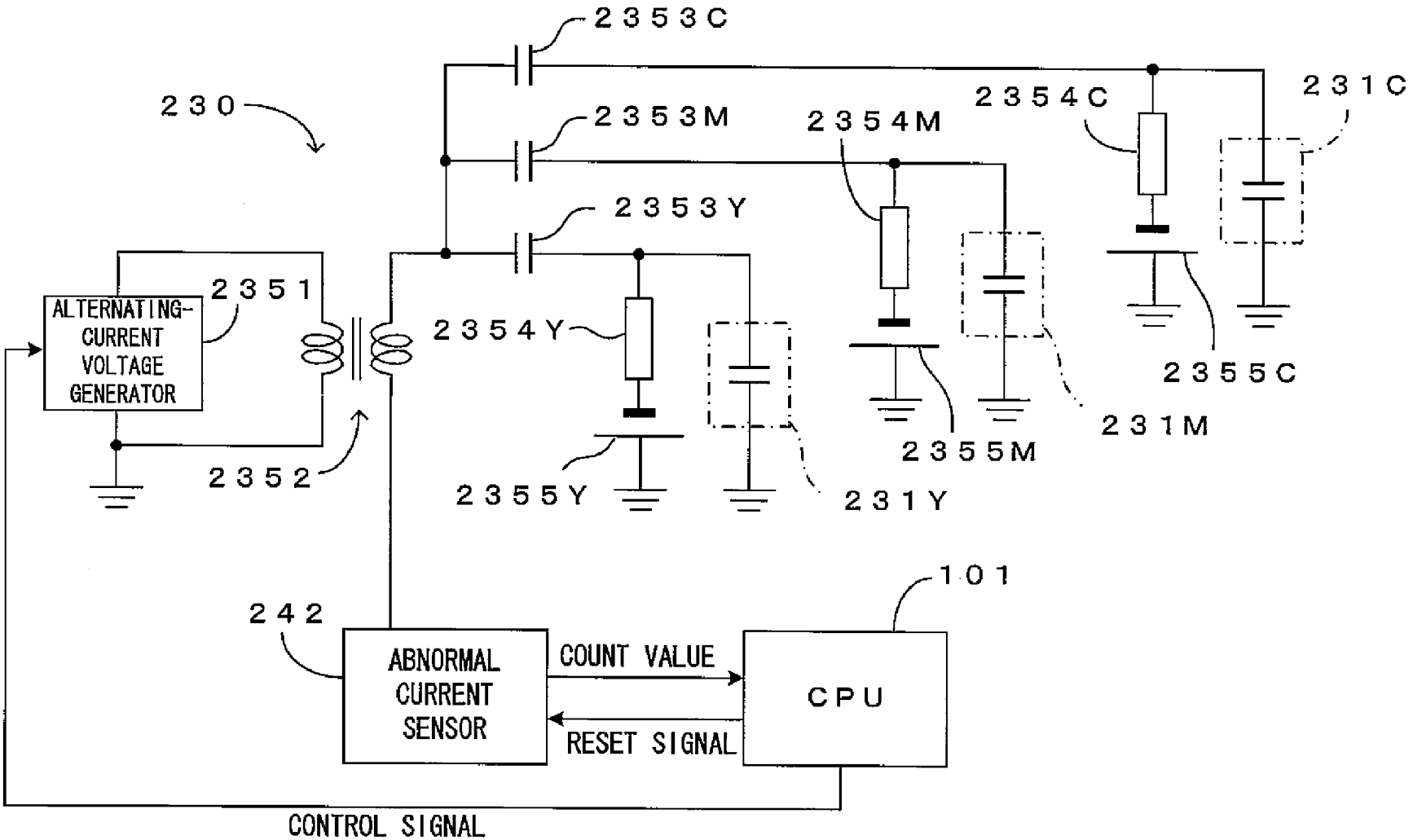
FIG. 10 is a diagram showing the electrical construction of the charger for the Y, M, and C image forming stations.

FIG. 10 is a diagram showing the electrical construction of the charger for the Y, M, and C image forming stations. The construction of the charger 230 is basically identical to that of the one for the black image forming station shown in FIG. 5, but differs therefrom in that an alternating-current voltage generator 2351, a transformer 2352 and an abnormal current sensor 242 are commonly used for the respective colors. In this charger 230, alternating-current voltages outputted from the alternating-current voltage generator 2351 and boosted by the transformer 2352 are applied to the charging rollers 231Y, 231M and 231C provided in the respective image forming stations 2Y, 2M and 2C via capacitors 2353Y, 2353M and 2353C for cutting off direct currents. In other words, the respective charging rollers 231Y, 231M and 231C are connected in parallel with each other when viewed from the charging bias generator.

Further, direct-current bias voltages 2355Y, 2355M and 2355C are applied to the respective charging rollers 231Y, 231M and 231C via resistors 2354Y, 2354M and 2354C. In this way, charging bias voltages, in each of which the alternating-current voltage is superimposed on the direct-current voltage, are applied to the respective charging rollers 231Y, 231M and 231C similar to the charging roller 231K of the black image forming station.

Out of secondary terminals of the transformer 2352, the one opposite to the respective charging rollers is connected with the abnormal current sensor 242. The construction of this abnormal current sensor 242 is identical to that of the abnormal current sensor 241 for the black image forming station. Since currents flowing in the respective charging rollers 231Y, 231M and 231C are collectively inputted to the abnormal current sensor 242 thus constructed, when a charging failure occurs in any one of the image forming stations, an occurrence thereof can be detected, but the image forming station having an abnormality cannot be specified. Particularly, in an image forming apparatus of the tandem development type as in this embodiment, the respective image forming stations 2Y, 2M and 2C simultaneously perform the image forming operations unlike an image forming apparatus of the rotary development type in which image forming stations are operated one by one in sequence.

Thus, currents resulting from the charging operations are superimposed on each other and, even if an abnormal current is detected, it is difficult to specify from which image forming station this abnormal current is inputted. By applying the invention to the apparatus having such a construction, the image forming station having an abnormality can be easily specified.

In this embodiment, by performing a second charging failure determining process described below, it becomes possible not only to detect an occurrence of an abnormality, but also to specify the image forming station having this abnormality and notify it to a user, whereby the user or an operator contacted by the user can know the cause of the abnormality at an early stage and take necessary measures.

Figure 11:
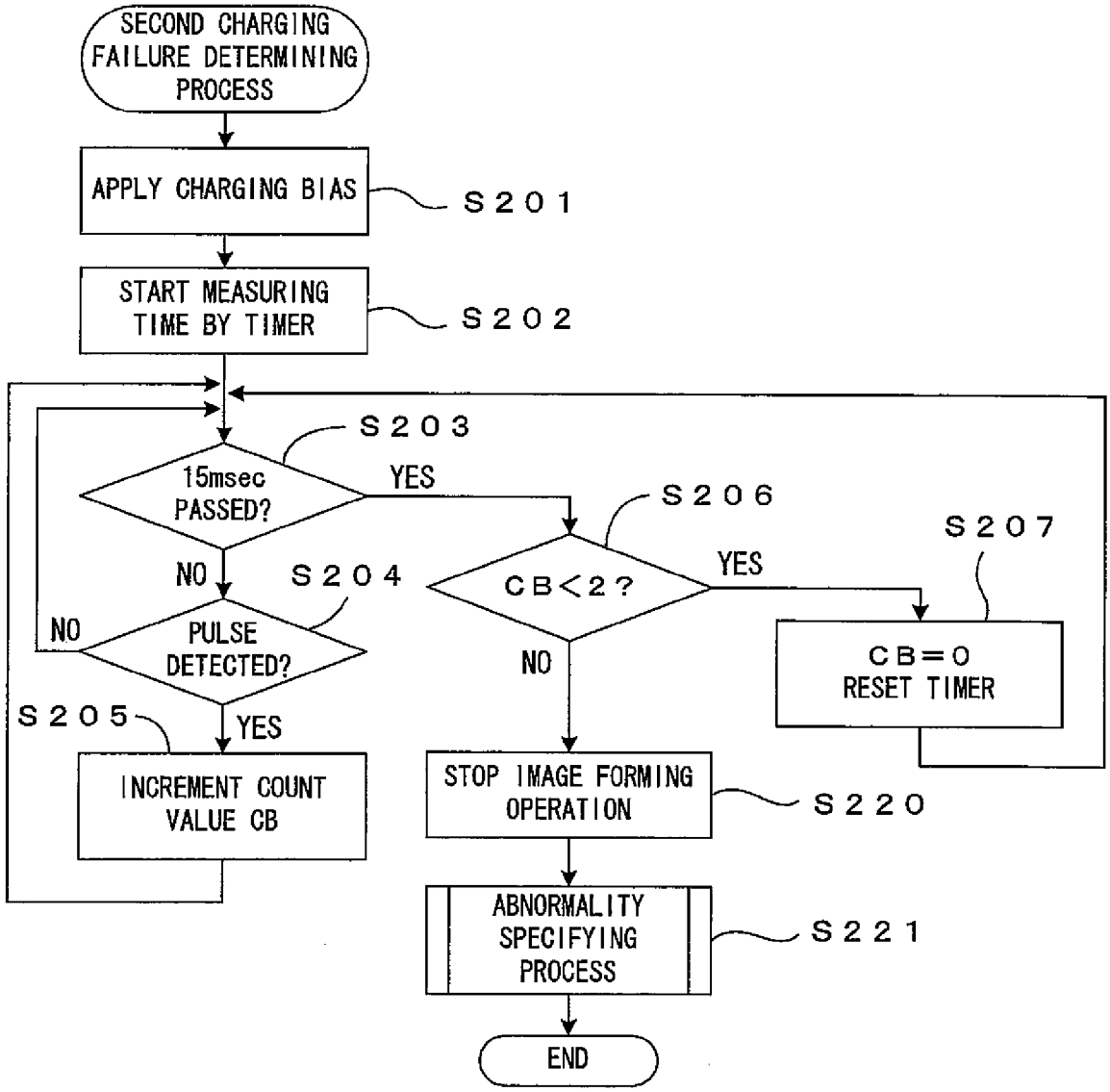
FIG. 11 is a flow chart showing the second charging failure determining process.

FIG. 11 is a flow chart showing the second charging failure determining process. In this process, Steps S201 to S207 are not described since being identical to Steps S101 to S107 in the first charging failure determining process for black in FIG. 9. In this second charging failure determining process, the operation performed when the count value CB within the detection period is 2 or larger (Step S206) is different from the one performed in the first charging failure determining process for black. Specifically, in this process, when the count value CB within the detection period is 2 or larger, the image forming operations are first stopped (Step S220), and subsequently, an abnormality specifying process for specifying the image forming station having the charging failure and coping with the abnormality is performed (Step S221). Since the black image forming station 2K is irrelevant to the abnormality specifying process, the operating state of the black image forming station 2K can be arbitrarily set.

Figure 12:
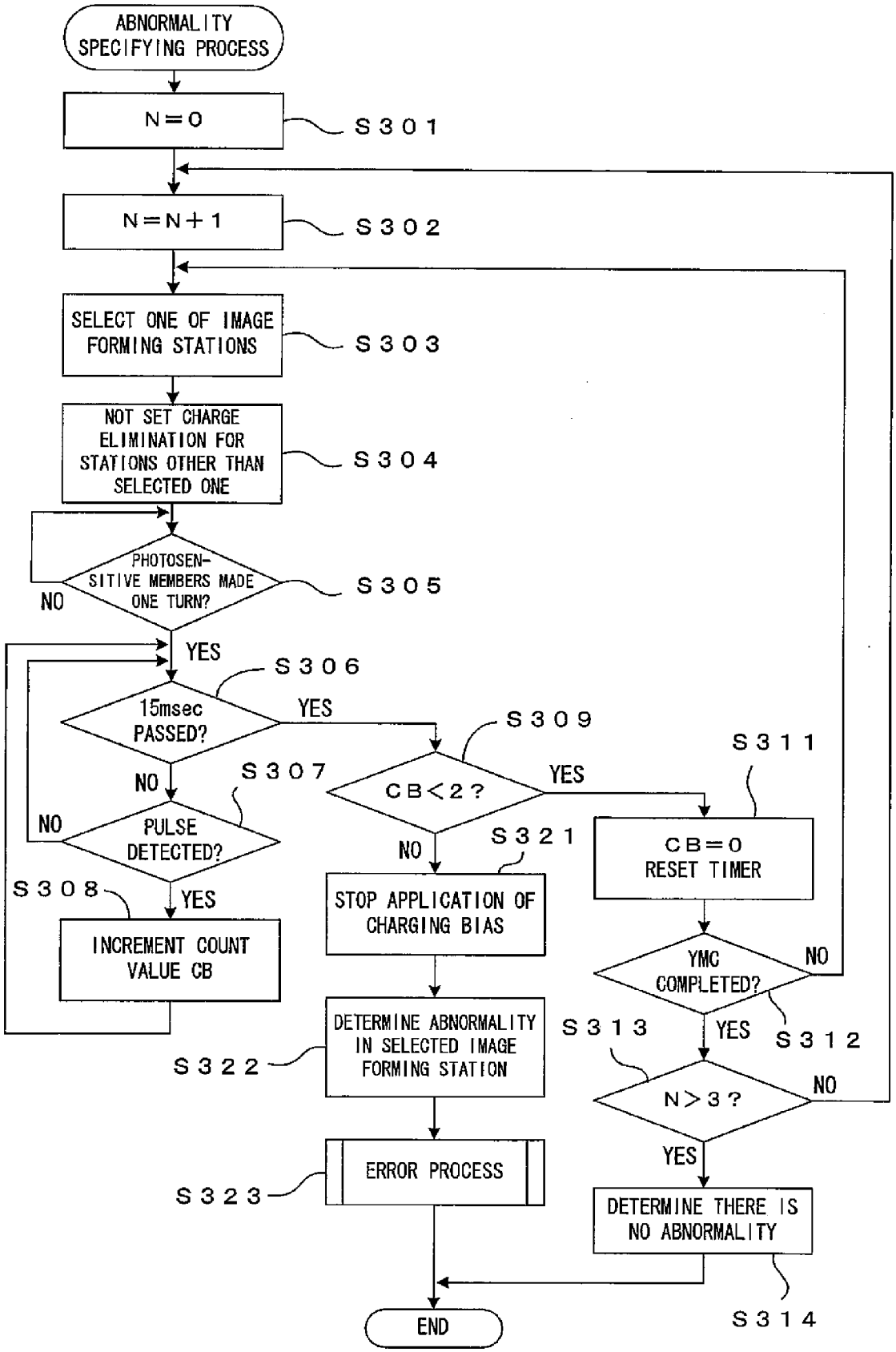
FIG. 12 is a flow chart showing the abnormality specifying process.

FIG. 12 is a flow chart showing the abnormality specifying process. In this process, a value N of an internal counter indicating the number of execution of a process loop is first reset (Step S301). Then, the value N of the counter is incremented (Step S302) and one of the image forming stations is selected (Step S303). Here, it is assumed that the yellow image forming station 2Y is selected first. Then, while the static eliminating light source 27 is turned on to eliminate residual charges on the photosensitive member 21 only for the selected image forming station 2Y, the line head 29 and the static eliminating light source 27 are turned off for the other image forming stations 2M and 2C so as not to eliminate electric charges on the photosensitive members 21 (Step S304).

The discharge between the photosensitive member 21 and the charging roller 231 occurs due to a large potential difference between the photosensitive member 21 and the charging roller 231. In a normal image forming operation, the static eliminating light source 27 is constantly kept on and the outer surface of the photosensitive member 21 conveyed to the position facing the charging roller 231 is constantly in a charge eliminated state. The surface potential of the photosensitive member 21 at this time is as low as about residual potential peculiar to the material of the photosensitive member 21. By bringing the photosensitive member 21 having such a low potential and the charging roller 231 having a high voltage applied thereto closer, the discharge occurs in the gap.

On the other hand, unless the electric charges on the photosensitive member 21 are eliminated, the outer surface of the photosensitive member 21 is kept at a high direct-current potential approximate to the potential immediately after the charging. Accordingly, no discharge occurs in the gap between the photosensitive member 21 not having the electric charges eliminated and the charging roller 231. Thus, a current flowing in the charging roller 231 in this state is a current resulting only from the charging and discharging to and from the electrostatic capacity formed between the charging roller 231 and the photosensitive member 21. By utilizing this, that is, by eliminating the electric charges on the photosensitive member 21 only for any one of the image forming stations, it can be specified in the gap of which image forming station the discharge is occurring.

Referring back to FIG. 12, it is waited until the photosensitive members 21 make one turn (Step S305) after the charge elimination is set for the yellow image forming station 2Y selected before and is not set for the other image forming stations. By turning the photosensitive members 21 at least one turn with the charge elimination set or without the charge elimination being set, the entire surfaces of the respective photosensitive members 21 are in stationary states by having the electric charges eliminated or not having the electric charges eliminated. In this state, similar to the aforementioned second charging failure determining process, the numbers of pulses generated within the detection period are counted (Steps S306 to S308). It should be noted that the length of the detection period here needs not be always equal to that of the second charging failure determining process.

At this time, if an abnormal discharge occurs in the selected image forming station 2Y, pulses resulting therefrom should be detected. Even if the cause of the abnormality lies in the other image forming station, no pulses resulting from the abnormality appear in this state where the charge elimination is not set. Thus, when the count value CB at this time is 2 or larger (Step S309), the application of the charging biases is immediately stopped (Step S321), it is determined that the abnormality is in the selected image forming station 2Y (Step S322), and an error process to be described later is performed (Step S323).

On the other hand, when the count value CB is below 2, the count value CB and the internal timer are reset, assuming that no abnormality has occurred in the image forming station 2Y at this point of time (Step S311). Then, the process performed thus far is performed for the other image forming stations 2M and 2C (Step S312). The error process is performed when pulses indicating the abnormality are detected in any one of the image forming stations in this process. If the pulses are detected in none of the Y, M, and C image forming stations, the above process is repeated until the count value reaches a specified value (three in this example) while incrementing the value N of the internal counter (Step S313). In other words, in this process, when no pulses are detected even if the above process is repeated three times, it is judged that there is no abnormality in any of the image forming stations (Step S314), and returns to a normal operation mode.

Thus, one image forming station is selected, and when the pulses indicating the abnormality are detected in the process performed only for the selected image forming station, it is found that there is an abnormality in the selected image forming station. In this way, the image forming station having the abnormality can be specified.

Figure 13:
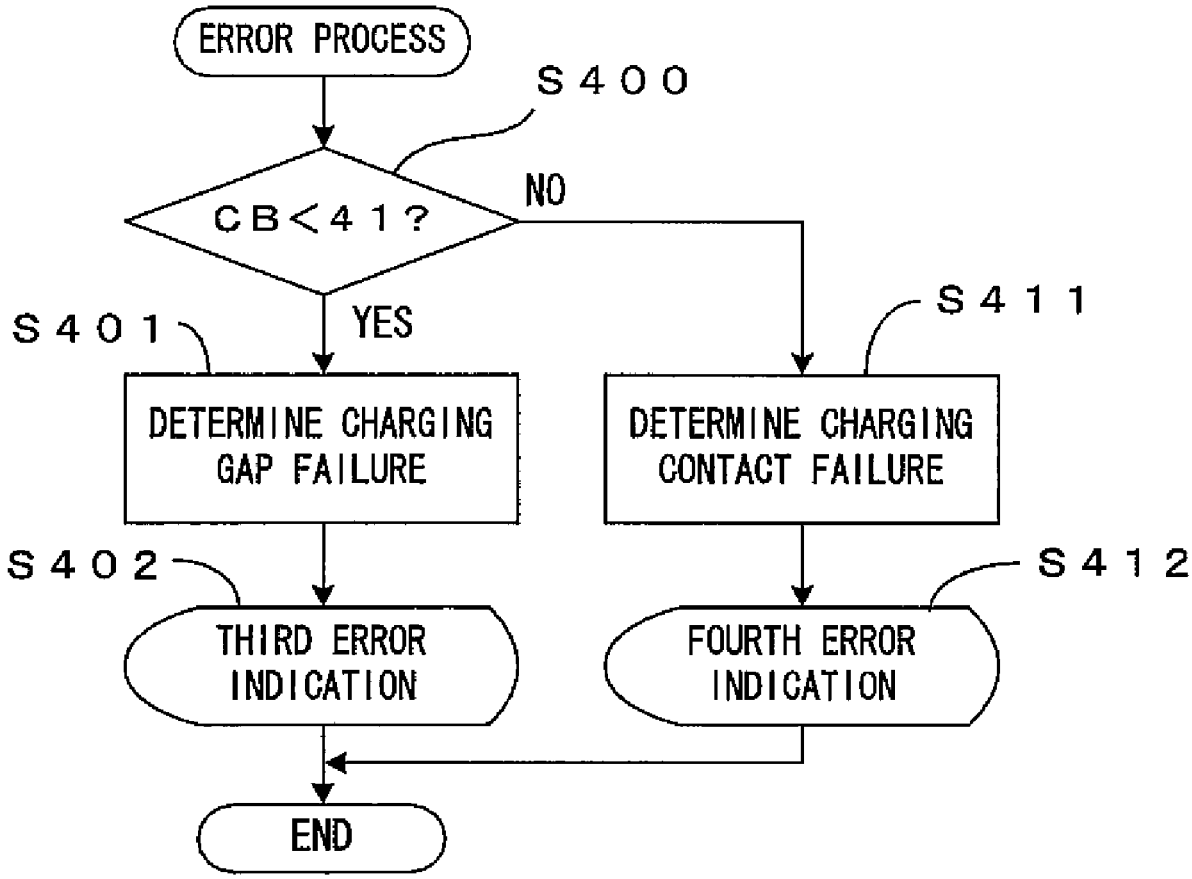
FIG. 13 is a flow chart showing an error process.

FIG. 13 is a flow chart showing the error process. The error process here is comprised of a process for specifying the cause of the abnormality and an error indication according to the content of the specified abnormality. This is similar to the process in the black image forming station in specifying the cause of the abnormality based on the count value CB of the pulses. Specifically, when the count value CB is 40 or below (Step S400), it is determined that the abnormal discharge resulting from the gap variation has occurred (Step S401), and a third error indication is displayed indicating the specified image forming station and the cause of the abnormality being the gap variation (Step S402). Since the application of the charging biases is already stopped, there is no likelihood that the abnormal discharge continues to damage the apparatus.

Further, when the count value CB exceeds 40, the cause of the pulses is judged to be the contact failure of the sliding contact (Step S411), and a fourth error indication is made to notify the cause of the pulses and the image forming station having the abnormality (Step S412). Thus, the user can take suitable measures against the abnormality at an early stage since he can know the image forming station having the abnormality and the cause of the abnormality.

As described above, according to this embodiment, in the image forming apparatus of the noncontact AC charging type in which the photosensitive members and the charging rollers are separated while defining the gaps therebetween and the alternating-current bias voltages are applied to the charging rollers to charge the photosensitive members, a charging failure resulting from an abnormal discharge in the gap is detected by extracting pulsed components in the charging current. By doing this, the charging failure in the noncontact AC charging method can be accurately detected.

Further, the cause of the charging failure is judged in accordance with the generation frequency of the pulsed components. Specifically, it is determined that the charging failure results from the gap variation when the generation frequency of the pulses is larger than a first threshold value, but smaller than a second threshold value larger than the first threshold value, whereas that the charging failure results from the contact failure when the generation frequency of the pulses is larger than the second threshold value. The cause of the charging failure is specified in this manner, and accordingly it is possible to help the user or operator remove the abnormality.

Since the pulses are detected by extracting the high-frequency components by means of the high-pass filter and comparing the extracted components with the reference level, the pulses can be reliably detected with a simple construction.

Further, it is possible to reduce the number of parts and downsize the apparatus by commonly using some of the functions of the charging bias generator and the abnormal current sensor for the image forming stations 2Y, 2M and 2C for the color mode that need not be singly operated. On the other hand, the charging bias generator and the abnormal current sensor are independently provided for the black image forming station 2K that needs to be singly operated in the monochromatic mode, whereby the application of the biases unnecessary in the monochromatic mode to the charging rollers 231 of the image forming stations other than the black one can be prevented and the charging failure during the execution of the monochromatic mode can also be detected.

Further, as for the image forming stations 2Y, 2M and 2C for the color mode, when the pulses leading to the charging failure are detected, the image forming stations are selected one by one in sequence and the pulses are detected without setting the charge elimination for the image forming stations other than the selected one, thereby being able to specify in which image forming station the abnormality is occurring.

As described above, in this embodiment, the respective image forming stations 2Y, 2M, 2C and 2K respectively correspond to "image forming stations" of the invention. Further, the image forming stations 2Y, 2M and 2C used only for the execution of the color mode corresponding to a "plural operation mode" of the invention correspond to "collective bias image forming stations" of the invention. On the other hand, the monochromatic mode in this embodiment corresponds to a "single operation mode" of the invention.

Also, in this embodiment, the photosensitive members 21 provided in the respective image forming stations function as "electrostatic latent image carriers" of the invention. Further, in this embodiment, the charging rollers 231 and the charging bias generator 232 respectively function as "charging members" and "bias applicator" of the invention. Furthermore, in this embodiment, the abnormal current sensors 241 and 242 function as a "current sensor" of the invention. Further, in this embodiment, the CPU 101 and the transfer belt 81 function as a "detector" and a "transfer medium" of the invention, respectively.

It should be appreciated that the invention is not limited to the embodiment above, but may be modified in various manners in addition to the embodiment above, to the extent not deviating from the object of the invention. For example, although the metallic charging rollers 231 are provided as the "charging members" of the invention in this embodiment, similar waveforms of charging currents can be observed in apparatuses including charging rollers made of rubber, in which electrical conductive fine power is dispersed, other than metal, and in apparatuses including charging members other than those in the form of rollers provided that the charging members can be arranged at a distance to the electrostatic latent image carriers and charging biases including alternating-current components are applied thereto. The invention can be suitably applied to such apparatuses.

Further, in the error processes of the above embodiment, although the contents of the messages displayed differ according to the contents of the abnormality, the error processes are not limited thereto and various other processes may be performed according to the type and content of the image forming station having the abnormality. For example, if it is confirmed that an abnormality has occurred in any one of the yellow, magenta and cyan image forming stations, but there is no abnormality in the black image forming station, an error process may be so performed as to permit only the execution of the monochromatic mode while prohibiting the execution of the color mode.

Further, although the abnormal current sensor and parts of the charging bias generator are commonly used for the image forming stations 2Y, 2M and 2C in the above embodiment, they may be commonly used for all the image forming stations also including the black image forming station 2K.

Further, although the outer surfaces of the photosensitive members 21 are irradiated with the static eliminating light beams Le from the static eliminating light sources 27 to have the residual charges eliminated in the above embodiment, residual charges may also be eliminated by bringing a charge eliminating member, for example, set at a specified potential into contact with the outer surfaces of the photosensitive members 21.

Further, the image forming apparatus of the above embodiment is a so-called tandem-type image forming apparatus in which the four image forming stations each including the photosensitive member are arranged side by side in the moving direction of the transfer belt 81. However, the invention is also applicable to a so-called rotary-type image forming apparatus in which a plurality of developing devices are mounted in a rotatable developing rotary and are selectively positioned to a position facing a photosensitive member to form an image.

Further, although the image forming apparatus of the above embodiment is an image forming apparatus including drum-shaped photosensitive members, belt-shaped photosensitive members for instance may be used as the electrostatic latent image carriers of the invention besides such drum-shaped ones. Further, the electrostatic latent image carriers are not limited to the photosensitive members on which electrostatic latent images are formed by light exposure, and any arbitrary member can be used provided that they can form electrostatic latent images by being charged to a specified surface potential.

Furthermore, although the invention is applied to a color image forming apparatus using four color toners of YMCK in the above embodiment, the apparatus-to-be-applied of the invention is not limited to this and is also applicable to image forming apparatuses for forming images using different colors and a different number of colors.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a plurality of image forming stations each including an electrostatic latent image carrier, a static eliminator that eliminates charges on the electrostatic latent image carrier, and a charging member that is arranged to face the electrostatic latent image carrier while defining a specified gap;

a bias applicator that collectively applies charging bias voltages including alternating-current components to the charging members provided in collective bias image forming stations, the collective bias image forming stations being at least two of the plurality of image forming stations;

a current sensor that collectively detects currents flowing in the charging members provided in the respective collective bias image forming stations; and a detector that detects an abnormal discharge in the gap between the electrostatic latent image carrier and the charging member based on a current detection result by the current sensor, wherein the detector selects one of the collective bias image forming stations as a selected image forming station, and determines presence or absence of the abnormal discharge in the gap between the electrostatic latent image carrier and the charging member in the selected image forming station based on the current detection result by the current sensor when the bias applicator applies the charging bias voltages to the charging members in the respective collective bias image forming stations while causing the static eliminator provided in the selected image forming station to operate and causing the static eliminators provided in the collective bias image forming stations other than the selected image forming station to stop operating.

2. The image forming apparatus according to claim 1, wherein the current sensor detects pulsed components included in the currents flowing in the charging members.

3. The image forming apparatus according to claim 2, wherein the detector determines that the abnormal discharge in the gap has occurred when the number of pulses detected by the current sensor within a specified detection period exceeds a specified threshold value.

4. The image forming apparatus according to claim 1, wherein the charging members provided in the respective collective bias image forming stations are connected in parallel with each other when viewed from the bias applicator.

5. The image forming apparatus according to claim 1, wherein the plurality of image forming stations are constructed to transfer images formed on the electrostatic latent image carriers to a transfer medium at mutually different image forming positions along a moving direction of the transfer medium moving in a specified direction.

6. The image forming apparatus according to claim 1, wherein a plural operation mode that forms an image using a plurality of image forming stations and a single operation mode that forms an image using one image forming station are executable, and the image forming stations used only in the plural operation mode are set as the collective bias image forming stations.

7. An abnormality determination method for an image forming apparatus that comprises a plurality of image forming stations each including an electrostatic latent image carrier and a charging member arranged to face the electrostatic latent image carrier while defining a specified gap, comprising:

collectively applying charging bias voltages including alternating-current components to the charging members provided in collective bias image forming stations, the collective bias image forming stations being at least two of the plurality of image forming stations;

collectively detecting currents flowing in the charging members provided in the respective collective bias image forming stations in a condition that, after charged by the charging member, the charge on an outer surface of the electrostatic latent image carrier in a selected image forming station is eliminated, and that the charge on the outer surfaces of the electrostatic latent image carriers in the collective bias image forming stations other than the selected image forming station is not eliminated, one of the collective bias image forming stations being selected as the selected image forming station; and determining presence or absence of an abnormal discharge in the gap between the electrostatic latent image carrier and the charging member in the selected image forming station based on a current detection result.

8. The abnormality determination method according to claim 7, wherein the image forming station having the abnormal discharge in the gap is specified out of the collective bias image forming stations by selecting the collective bias image forming stations one by one in sequence as the selected image forming station.

* * * * *